United States Patent [19]

Zimmer

[11] 3,999,479

[45] Dec. 28, 1976

[54] DYESTUFF APPLICATOR

[76] Inventor: Peter Zimmer, Untere Sparchen 54, A 6330 Kufstein, Austria

[22] Filed: Apr. 29, 1975

[21] Appl. No.: 572,640

[30] Foreign Application Priority Data

Apr. 30, 1974 Austria ..... 3576/74

[52] U.S. Cl. ..... 101/120; 118/406

[51] Int. Cl.[2] ..... B41F 15/40

[58] Field of Search ..... 101/114, 115, 116, 118, 101/122, 123, 124; 118/406

[56] References Cited

UNITED STATES PATENTS

| | | | |
|---|---|---|---|
| 2,964,339 | 12/1960 | Macks | 101/116 X |
| 3,673,958 | 7/1972 | Billiet | 101/122 |
| 3,807,302 | 4/1974 | Kudlich | 101/119 |

FOREIGN PATENTS OR APPLICATIONS

| | | | |
|---|---|---|---|
| 2,250,092 | 7/1974 | Germany | 101/120 |
| 2,302,084 | 7/1974 | Germany | 101/120 |

*Primary Examiner*—Clifford D. Crowder
*Assistant Examiner*—R. E. Suter
*Attorney, Agent, or Firm*—Ernest G. Montague; Karl F. Ross; Herbert Dubno

[57] ABSTRACT

A horizontal dyestuff-supply tube within a cylindrical printing screen supports a prismatic applicator housing whose bottom is formed from two transversely spaced angle profiles for the guidance of a vertically movable distributing member. The latter is in the shape of a block with a multiplicity of vertical passages terminating at its underside in a discharge slot, the block penetrating upwardly into the applicator housing and supporting a perforated slack membrane of rubber or the like secured to the upper block surface and to the lateral inner bottom surfaces of the housing to form aprons preventing the penetration of dyestuff along the guide surfaces of the angle profiles. These profiles may be interconnected by transverse bolts passing through vertical clearances formed in the distributing member between its passages.

13 Claims, 5 Drawing Figures

RESINOUS MASS

RESINOUS MASS

DYESTUFF APPLICATOR

FIELD OF THE INVENTION

My present invention relates to a dyestuff applicator for an apertured printing screen which overlies a substrate to be imprinted and is movable together with that substrate in a predetermined direction while liquid dyestuff (sometimes referred to as ink) is delivered to a narrow zone on the upper screen surface, in its region of contact with the substrate, via a narrow discharge slot perpendicular to the direction of screen motion.

BACKGROUND OF THE INVENTION

Dyestuff applicators of this description have been disclosed in various copending applications of mine including, for example, applications Ser. Nos. 426,909 filed Dec. 20, 1973 (now U.S. Pat. No. 3,949,666) 437,039 filed Jan. 28, 1974, 438,261 filed Jan. 31, 1974 (now U.S. Pat. No. 3,949,667)and 438,282 filed Jan. 31, 1974. The devices disclosed in these prior applications basically comprise a rigid housing, supported on a horizontal supply tube, in which a generally prismatic distributing member is vertically slidable so as to yield to irregularities in the thickness of the substrate. In order to minimize leakage of liquid dyestuff between the distributing member and its guide structure, the discharge slot at the underside of the distributing member may be spanned by membranes or foils with different degrees of resiliency, partly slotted and partly perforated, as described for example in my prior application Ser. Nos. 364,560 filed May 29, 1973 (now U.S. Pat. No. 3,921,520), 376,714 filed July 5, 1973 (abandoned and replaced by Ser. No. 582,925 filed June 2, 1975) and 430,389 filed Jan. 3, 1974 (now U.S. Pat. No. 3,942,439).

OBJECTS OF THE INVENTION

An object of my present invention is to provide an even simpler solution to the problem of leakage prevention in such a device.

Another object is to provide a dyestuff applicator of improved mechanical stability effectively protected against leakage.

SUMMARY OF THE INVENTION

These objects are realized, in accordance with my present invention, by the provision of a two-part dyestuff applicator of the general type disclosed in my copending applications and patents, i.e. with a rigid applicator housing and a substantially prismatic distributing member slidably guided therein, in combination with a flexible and preferably elastic membrane secured to the distributing member and to adjoining lateral surfaces of the housing bottom for preventing leakage of the dyestuff between that member and a pair of downwardly extending guide elements flanking a gap in the housing bottom.

In order to give access to the discharge slot in the lower part of the distributing member, the overlying membrane should be either apertured or split into two transversely separated halves.

The guide elements are advantageously a pair of webs forming part of two angle profiles with horizontal flanges forming the housing bottom, these webs being interconnected by longitudinally spaced horizontal stays passing through vertical clearances of the distributing member which are isolated from passages for the dyestuff. The flanges of the profiles may be overlain by bent-over lower edges of the sidewalls of the applicator housing, serving to clamp the membrane edges therebetween.

BRIEF DESCRIPTION OF THE DRAWING

The above and other features of my invention will now be described in detail with reference to the accompanying drawing in which.

SPECIFIC DESCRIPTION

Figure 3:
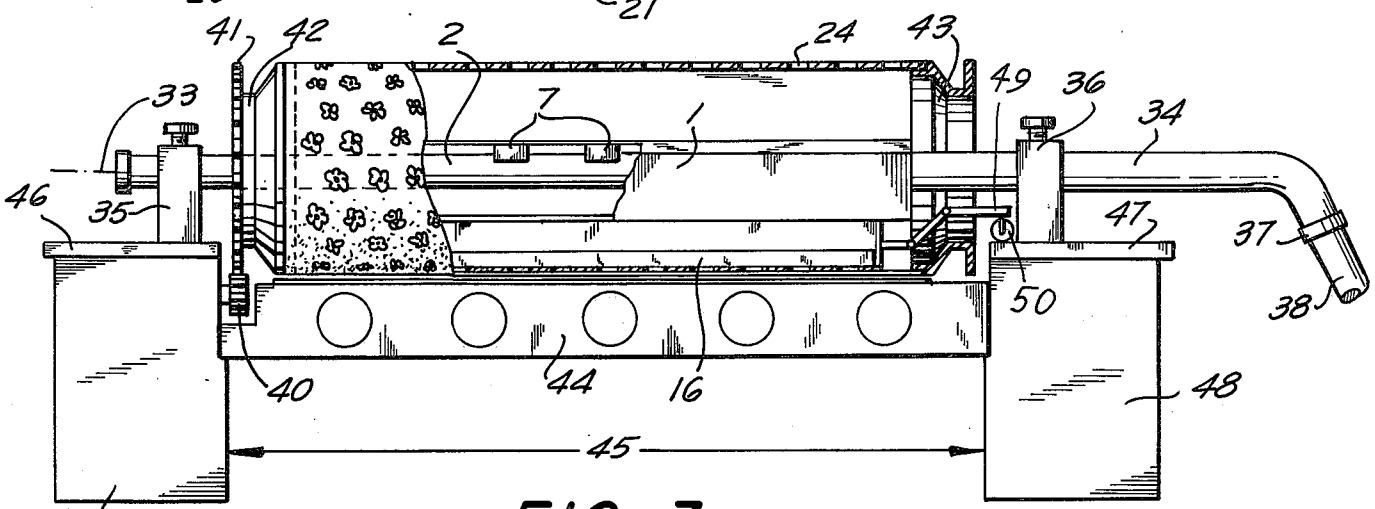
FIG. 3 is a side-elevational view (parts broken away) of a screen printer incorporating the applicator of FIG. 1.

Reference will be first made to FIG. 3 showing a cylindrical printing screen 24 with heads 42, 43 supported in nonillustrated journal bearings for rotation about a horizontal axis 33, head 42 being rigid with a gear 41 engaged by a pinion 40 driven from a gear box 39 forming part of the machine frame. That frame includes a bed 44 flanked by gear box 39 and a similar dummy box 48 separated from each other by a distance 45 of several meters. Bed 44 has a top 29 (FIG. 1) slidably supporting a substrate 28 to be imprinted, this substrate being entrained in a direction 30 (to the right in FIG. 1) by the screen 24 whose direction of rotation has been indicated at 25.

A supply tube 2, centered on axis 33, has an extension 34 connected by a joint 37 to a pipe 38 which leads to a nonillustrated source of liquid dyestuff under pressure, e.g. as disclosed in my copending application Ser. No. 449,473 filed Mar. 8, 1974 and now abandoned. Instead of a single supply tube fed at one end as shown, I may use a pair of symmetrical tubes with closed confronting ends extending about half-way into the screen 24 from opposite sides and communicating separately with the fluid source.

Figure 1:
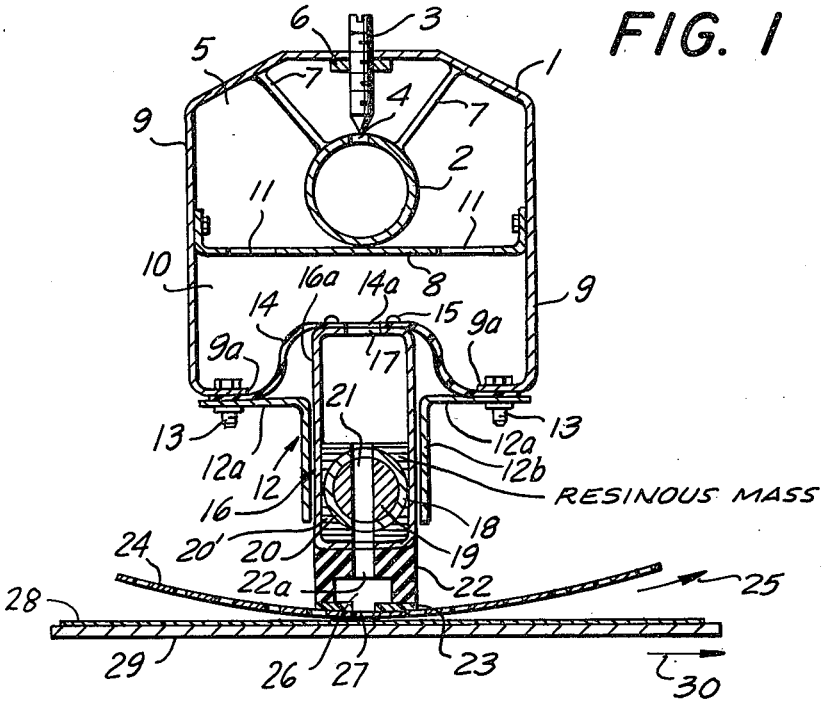
FIG. 1 is a cross-sectional view of a dyestuff applicator according to my invention.

FIG. 3 further shows bearing posts 35, 36 which rise from cover plates 46 and 47 of boxes 39 and 48 to hold the tube 2 stationary. An applicator housing 1, more fully illustrated in FIG. 1, is supported on that tube by upwardly diverging fins 7 whose length in the axial direction is a small fraction of distance 45, e.g. on the order of 10 cm. A distributing member 16, comprising a hollow prismatic block **16*a*, is slidably guided in the bottom of applicator housing 1** so as to come to rest on the inner screen surface at the nadir thereof.

Tube 2 is provided at its top with a multiplicity of longitudinally spaced apertures 4 (one of them being shown in FIG. 1) which can be throttled to a variable extent by screws 3 passing through fixedly positioned nuts 6. A horizontal partition 8, provided with large openings 11 for the downward passage of printing liquid issuing from apertures 4, is soldered or otherwise secured to the undersurface of tube 2 and subdivides the interior of housing 1 into an upper and a lower compartment 5 and 10, respectively. Partition 8 is bolted onto opposite side walls 9 of the housing which terminate in inbent lower edges **9*a*; the housing bottom is formed by flanges 12***a* of a pair of angle profiles 12 whose vertical webs 12*b* constitute guide elements for the hollow block 16*a*. This block penetrates upwardly into the housing compartment 10, through a gap formed between the transversely spaced profiles 12, and supports an elastomeric membrane 14 of natural rubber, for example, which is fastened to the top of member 16 by screws 15 and is marginally clamped between edges 9*a* and flanges 12*a*, in a fluidtight manner, by screws 13. Apertures 17 in the top of block 16*a* facilitate the descent of the dyestuff through that block to a distribution channel 26 formed within a rubber profile 22, this profile being fastened to the underside of block 16*a* and having holes 22*a* for the passage of the liquid. Channel 26 is partly closed from below by two Teflon strips 23 defining between them a discharge slot 27 while facilitating relative sliding between member 16 and screen 24. The membrane 14 is a continuous foil havng openings 14*a* registering with the apertures 17; its two halves form a pair of aprons, weighted down by the overlying liquid volume under pressure, which not only prevent leakage between flanges 12*b* and block 16*a* but also bias the Teflon strips 23 of member 16 into firm contact with the surface of screen 24 so as to prevent the liquid from escaping onto that screen surface instead of pentrating the pattern-forming perforations of the screen to imprint the underlying substrate 28.

The lower portion of the interior of block 16*a* is filled with a resinous mass 20' enveloping a thin-walled tube 20 in which a shutter rod 19 is rotatably lodged, this rod having transverse bores 21 aligned with the openings in tube 20 and with apertures 22*a* when rod 19 is in its illustrated unblocking position. By a linkage 49 and a servometer 50, FIG. 3, the rod 19 may be turned through 90° to stop the outflow of dyestuff as more fully described in my copending application Ser. No. 438,261 (U.S. Pat. No. 3,949,667) referred to above.

Figure 2:
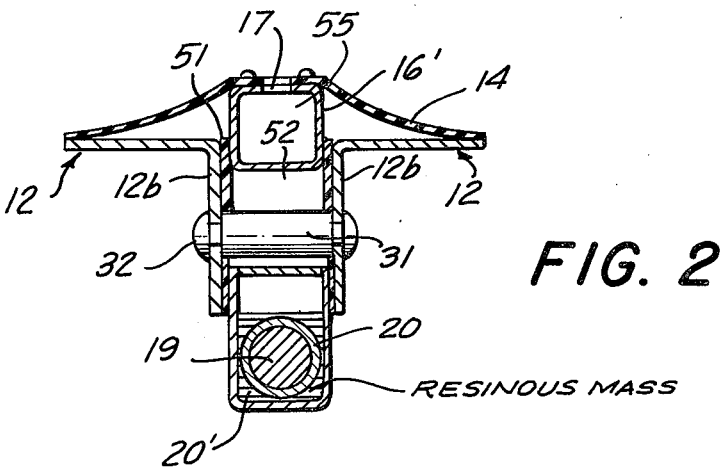
FIG. 2 is a cross-sectional view of a modification of a distributing member included in the applicator of FIG. 1, drawn to a somewhat larger scale.
Figure 4:
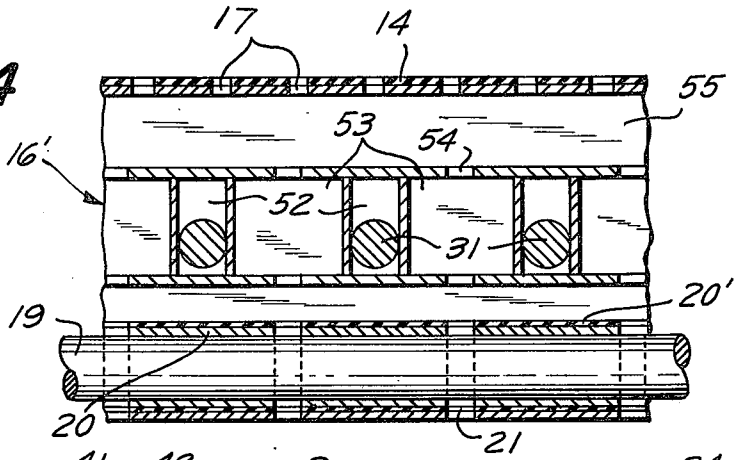
FIG. 4 is a fragmentary longitudinal sectional view of the distributing member shown in FIG. 4.

The guide surfaces of webs 12*b* and/or the coacting outer surfaces of block 16*a* could also be coated with layers of anti-friction material such as Teflon to improve the vertical slidability of that member. Such layers have been illustrated at 51 in FIG. 2 which also shows a modified distributing member 16' formed with vertical clearances 52 for the passage of stay bolts 31 secured by heads 32 to the webs 12*b* of profiles 12. As seen in FIG. 4, the clearances 52 are isolated from spaces 53 which communicate via apertures 21 with the discharge slot 27 shown in FIG. 1 and via other apertures 54 with an upper distribution channel 55. The bolts 31 consolidate the two sides of the applicator housing into a rigid structure without, however, impeding the vertical mobility of distributing member 16'.

Figure 5:
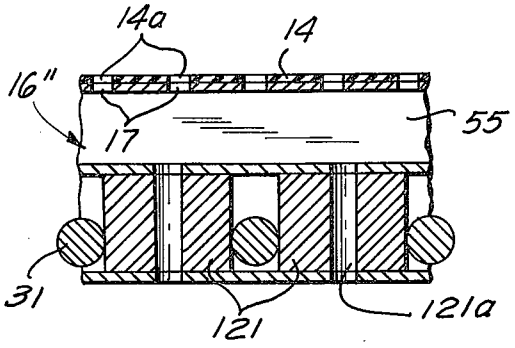
FIG. 5 is a fragmentary view generally similar to FIG. 4, illustrating a modification.

As shown in FIG. 5, a further modified distributing member 16'' may comprise a multiplicity of vertical cylinders 121 with bores 121*a* for the passage of the liquid between a distribution channel 55 and a nonillustrated discharge gap at the bottom, the stay bolts 31 extending between adjoining cylinders. It will be noted from FIGS. 4 and 5 that these bolts contribute to the stability of the distributing member by giving it additional guidance. Thus, the end walls of housing 1 need not be extended downwardly for such guidance although, of course, they could also be formed with depending elements similar to webs 12*b*. In any event, the rubber foil 14 is advantageously extended past the ends of the distributing member and clamped or otherwise secured in a fluidtight manner to the housing ends.

It should be understood that my improved applicator construction is not limited to printing machines with cylindrical screens but could be used also with generally flat stencil sheets.

I claim

1. A dyestuff applicator for a printing screen, comprising:

an apertured tube extending generally horizontally above a zone of contact between a printing screen and a substrate to be imprinted, said tube being connected to a source of liquid dyestuff;

a housing supported on said tube and surrounding same, said housing being provided with a bottom having a longitudinally extending gap flanked by a pair of downwardly extending guide elements;

a distributing member vertically slidable between said guide elements and provided with a multiplicity of vertical passages for said dyestuff terminating in a discharge slot parallel to but substantially narrower than said gap, said passages communicating with the interior of said housing; and a continuous flexible foil of elastomeric material secured to said member and to adjoining lateral surfaces of said bottom for preventing leakage of said dyestuff between said member and said guide elements, said foil having apertures overlying said passages.

2. A dyestuff applicator for a printing screen, comprising:

an apertured tube with a generally horizontal axis extending above a zone of contact between a printing screen and a substrate to be imprinted, said tube being connected to a source of liquid dyestuff;

a housing supported on said tube and surrounding same;

two spaced-apart angle profiles with horizontal flanges forming a bottom for said housing, said flanges being separated by a gap paralleling said axis, and with downwardly extending webs flanking said gap, said housing having sidewalls with bent-over lower edges overlying said flanges;

a distributing member vertically slidable between said guide elements and provided with a discharge slot parallel to but substantially narrower than said gap communicating with the interior of said housing; and flexible membrane means secured to said member and marginally clamped between said lower edges and said flanges for preventing leakage of said dyestuff between said member and said webs.

3. A dyestuff applicator for a printing screen, comprising:

an apertured tube with a generally horizontal axis extending above a zone of contact between a printing screen and a substrate to be imprinted, said tube being connected to a source of liquid dyestuff;

a housing supported on said tube and surrounding same;

two spaced-apart angle profiles with horizontal flanges forming a bottom for said housing, said flanges being separated by a gap paralleling said axis, and with downwardly extending webs flanking said gap;

a distributing member vertically slidable between said webs and provided with a multiplicity of vertical passages for said dyestuff terminating in a discharge slot parallel to but substantially narrower then said gap, said passages communicating with the interior of said housing, said member being further provided with vertical clearances isolated from said passages;

flexible membrane means secured to said member and to said flanges for preventing leakage of said dyestuff between said member and said webs; and horizontal stays interconnecting said webs and passing through said clearances.

4. A dyestuff applicator as defined in claim 3, wherein said housing is provided with a perforated horizontal partition spacedly overlying said membrane means at the underside of said tube.

5. A dyestuff applicator for a printing screen, comprising:

an apertured tube extending generally horizontally above a zone of contact between a printing screen and a substrate to be imprinted, said tube being connected to a source of liquid dyestuff;

a housing supported on said tube and surrounding same, said housing being provided with a bottom having a longitudinally extending gap flanked by a pair of downwardly extending guide elements;

a distributing member vertically slidable between said guide elements and provided with a discharge slot parallel to but substantially narrower than said gap communicating with the interior of said housing;

flexible membrane means secured to said member and to adjoining lateral surfaces of said bottom for preventing leakage of said dyestuff between said member and said guide elements; and a perforated horizontal partition in said housing spacedly overlying said membrane means at the underside of said tube.

6. A dyestuff applicator as defined in claim 5 wherein said member penetrates upwardly into the interior of said housing and has an upper surface above the level of said bottom, said membrane means being secured to said upper surface.

7. A dyestuff applicator as defined in claim 5, wherein said member is provided on its underside with antifriction strips on both sides of said slot.

8. A dyestuff applicator as defined in claim 5, further comprising a multiplicity of longitudinally spaced-apart fins secured to said tube and to said housing above said partition.

9. A dyestuff applicator as defined in claim 5 wherein said member is provided with a multiplicity of vertical passages for said dyestuff terminating at said discharge slot, said membrane means leaving said passages uncovered.

10. A dyestuff applicator as defined in claim 9 wherein said membrane means comprises a continuous foil of elastomeric material with apertures overlying said passages.

11. A dyestuff applicator as defined in claim 9, wherein said guide elements are a pair of webs forming part of two angle profiles with horizontal flanges forming said bottom.

12. A dyestuff applicator as defined in claim 11 wherein said member is provided with vertical clearances isolated from said passages further comprising horizontal stays interconnecting said webs and passing through said clearances.

13. A dyestuff applicator as defined in claim 11 wherein said housing has sidewalls with bent-over lower edges overlying said flanges, said membrane means being marginally clamped between said lower edges and said flanges.

* * * * *